US005963037A

United States Patent [19]

Brady et al.

[11] Patent Number: 5,963,037

[45] Date of Patent: Oct. 5, 1999

[54] METHOD FOR GENERATING A FLOW PROFILE OF A WELLBORE USING RESISTIVITY LOGS

[75] Inventors: Jerry L. Brady; Becky A. Watson; Robert J. North, all of Anchorage, Ak.

[73] Assignee: Atlantic Richfield Company, Los Angeles, Calif.

[21] Appl. No.: 08/906,862

[22] Filed: Aug. 6, 1997

[51] Int. Cl.[6] ..... G01V 3/18; G01V 3/36; G01V 3/38; E21B 49/00

[52] U.S. Cl. ..... 324/338; 73/152.05; 73/152.41; 175/50; 324/323; 324/324; 324/369; 702/13

[58] Field of Search ..... 324/323, 324, 324/338, 339, 351, 355, 356, 366, 369; 73/152.02, 152.03, 152.05, 152.06, 152.39, 152.41; 166/252.5, 250.02; 175/50; 250/254, 256, 259; 702/6, 7, 9, 11–13

[56] References Cited

U.S. PATENT DOCUMENTS

| | | | |
|---|---|---|---|
| 4,276,599 | 6/1981 | Timmons et al. | 324/339 |
| 4,378,047 | 3/1983 | Elliott et al. | 166/68 |
| 4,531,584 | 7/1985 | Ward | 166/265 |
| 4,531,593 | 7/1985 | Elliott et al. | 175/71 |
| 4,610,793 | 9/1986 | Miller | 210/767 |
| 4,981,175 | 1/1991 | Powers | 166/265 |
| 4,995,456 | 2/1991 | Cornette et al. | 166/51 |
| 5,214,384 | 5/1993 | Sprunt et al. | 324/351 |
| 5,343,945 | 9/1994 | Weingarten et al. | 166/105.5 |
| 5,385,446 | 1/1995 | Hays | 415/202 |
| 5,431,228 | 7/1995 | Weingarten et al. | 166/357 |
| 5,450,901 | 9/1995 | Ellwood | 166/266 |
| 5,482,117 | 1/1996 | Kolpak et al. | 166/265 |
| 5,605,193 | 2/1997 | Bearden et al. | 166/370 |
| 5,730,871 | 3/1998 | Kennedy et al. | 210/512.2 |
| 5,794,697 | 8/1998 | Wolflick et al. | 166/265 |

OTHER PUBLICATIONS

Glossary of Terms & Expression Used in Well Logging, Second Edition, Society of Professional Well Log Analysis, Oct., 1984.

"Development and Testing of a Compact Liquid–Gas Auger Partial Separator for Downhole or Surface Applications" by J.S. Weingarten, M.M. Kolpak, S.A. Mattison and M.J. Williamson, Society of Petroleum Engineers, Feb. 1997.

"Slim Phase 4™", Sperry–Sun Drilling Services, 1994, 1995, no month available.

"New Design Expands Success of Slim Phase 4™ MWD Resistivity Tool", Real–time—Slim Phase 4™, Sperry Drilling Services, Fall 1995, no month available.

(List continued on next page.)

*Primary Examiner*—Gerard Strecker
*Attorney, Agent, or Firm*—F. Lindsey Scott

[57] ABSTRACT

A method for generating a flow profile of a wellbore whereby a resistivity tool is run through the wellbore, while the wellbore is being drilled, to sequentially measure and record, at each of a sequence of selected points along the wellbore, a sequential series of resistivities measured while drilling (MWD). Fluid from the wellbore is then allowed to permeate into the formation. The resistivity tool is then run through the wellbore, after the drilling mud has permeated into the formation, to sequentially measure and record, at substantially the same points at which the MWD resistivity measurements were made, a sequential series of resistivities measured after drilling (MAD). For each point, the arithmetic difference between the MWD resistivity and the corresponding MAD resistivity recorded for the respective point is calculated. For each respective point in the sequence of points, the sum of the arithmetic differences for the respective point and each point which follows the respective point in the sequence of points is recorded. A flow profile of the wellbore is generated by plotting the value of the sums calculated for each point of the sequence of points, wherein the magnitude of the permeability of a zone in the formation and, hence, of the potential productive flow from that point in the wellbore, is substantially proportional to the magnitude of the slope of the profile corresponding to that point.

20 Claims, 2 Drawing Sheets

OTHER PUBLICATIONS

"Improved Production Log Intepretation in Horizontal Wells Using Pulsed Neutron Logs", by J.L. Brady, J.J. Kohring and R.J. North, SPE 36625, Society of Petroleum Engineers, 1996, no month available.

"New Design for Compact Liquid–Gas Partial Seperation: Downhole and Surface Installations for Artificial Lift Applications" by J.S. Weingarten, M.M. Kolpak, S.A. Mattison and M.J. Williamson, SPE 30637, Society of Petroleum Engineers, 1995, no month available.

"Jet Pumping" by Hal Petrie, Chapter 6 of "The Technology of Artificial Lift Methods"—Vol. 2b. (Undated).

METHOD FOR GENERATING A FLOW PROFILE OF A WELLBORE USING RESISTIVITY LOGS

FIELD OF THE INVENTION

The invention relates generally to a method for generating a flow profile of a wellbore and, more particularly, to a method for generating a flow profile of a wellbore from resistivity logs.

BACKGROUND OF THE INVENTION

In the exploration of oil in subterranean formations, logs may be made, via a wellbore in the formation, of the resistivity of the formation typically measured at depths of from about 15 to about 150 inches away from wellbore. Resistivity may be measured while drilling (MWD) the wellbore to geosteer, correlate formations, measure pre-invasion resistivity, pick casing points, and evaluate pore pressures.

In addition to MWD resistivity, the resistivity of formations may also be measured after drilling (MAD), for example, twelve to twenty-four hours after drilling. The time after drilling allows drilling mud in the wellbore to enter into the formation. It can be appreciated that the depth of entry of the mud into the formation will be proportional to the permeability and porosity of the formation, and that the resistivity of the formation will change to the extent that mud has entered the formation. By graphically overlaying the MWD and MAD resistivity logs, a qualitative correlation may be made between the regions of difference, or separation, between the MWD and MAD logs, and the zones of permeability in the formation. The potential productivity zones and the flow profile of a wellbore may then be developed based on the indicated zones of permeability of the wellbore.

While resistivity logs are useful, particularly when the logs are taken from horizontal wellbores, for providing a qualitative indication of the productivity of a wellbore, they do not provide useful quantitative indications of the productivity of a wellbore. It is thus difficult to reliably interpret MWD and MAD resistivity logs to determine the flow profile of a wellbore. Such difficulty results, for example, when the resistivity logs are erratic or are plotted using a non-linear scale, such as a logarithmic scale.

Therefore, what is needed is a method for reliably interpreting MWD and MAD resistivity logs to determine the flow profile of a wellbore.

SUMMARY OF THE INVENTION

According to the present invention, MWD and MAD resistivity log data may be more reliably interpreted to determine the flow profile of a wellbore by a method whereby a resistivity tool is run through the wellbore, while the wellbore is being drilled, to sequentially measure and record, at each of a sequence of selected points along the wellbore, a sequential series of resistivities measured while drilling (MWD). Fluid from the wellbore is then allowed to permeate into the formation. The resistivity tool is then run through the wellbore, after the fluid has permeated into the formation, to sequentially measure and record, at substantially the same points at which the MWD resistivity measurements were made, a sequential series of resistivities measured after drilling (MAD). For each point, the arithmetic difference between the MWD resistivity and the corresponding MAD resistivity recorded for the respective point is calculated. For each respective point in the sequence of points, the sum of the arithmetic differences for the respective point and each point which follows the respective point in the sequence of points is recorded. A flow profile of the wellbore is generated by plotting the value of the sums calculated for each point of the sequence of points, wherein the magnitude of the permeability of a zone in the formation and, hence, of the potential productive flow from that point in the wellbore, is substantially proportional to the magnitude of the slope of the profile corresponding to that point.

DESCRIPTION OF THE PREFERRED EMBODIMENT

Conventional terminology will be used herein to the refer to the order of a point in the sequence of the points in a wellbore wherein, for example, the uppermost point or the point closest to the wellhead will be referred to as the "first" point in the sequence, the next adjacent point as the "second" point, and so forth with the remaining points in sequence to the lowermost point or the point furthermost from the wellhead which will be referred to as the "last" point in the sequence. Points "preceding" a reference point include the first point and all points between the first point and the reference point. Points "following" a reference point include the last point and all points between the last point and the reference point.

Figure 1:
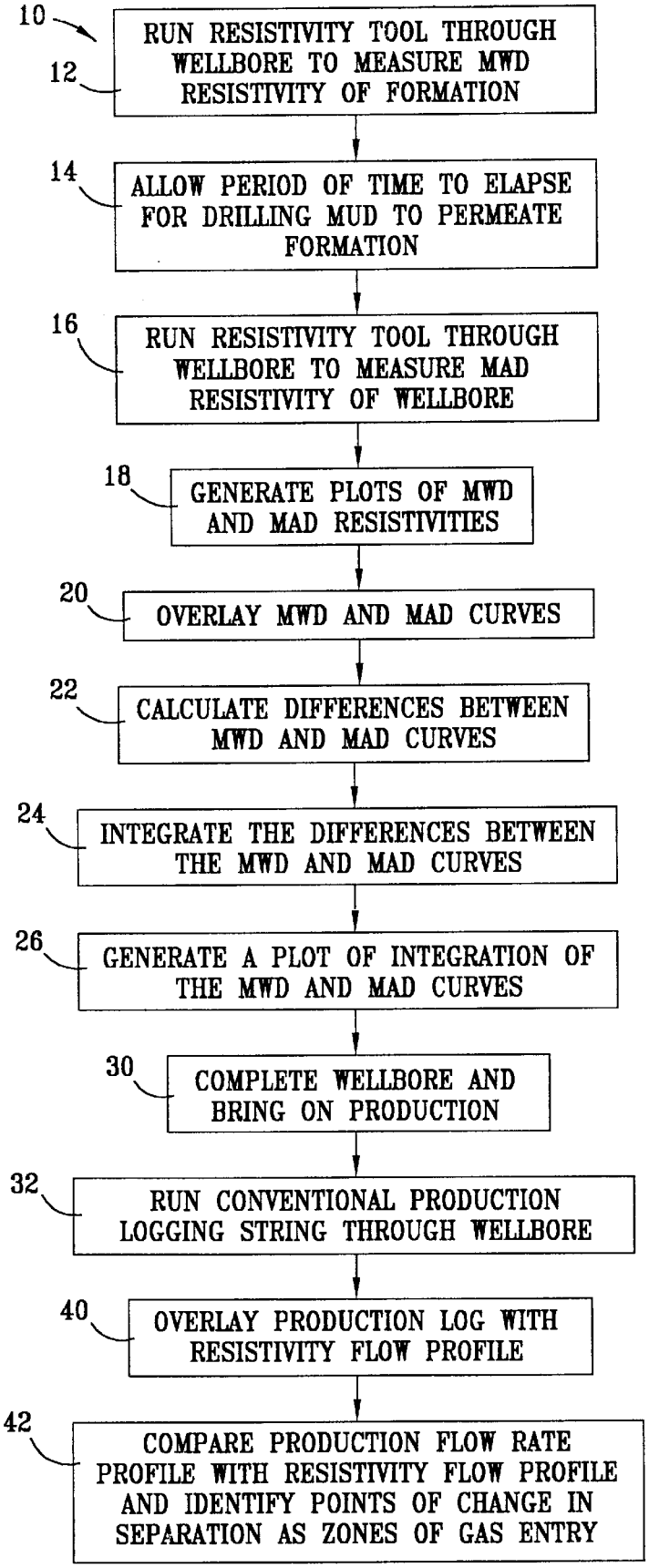
FIG. 1 is a flowchart of a method for determining the flow profile of a wellbore in accordance with the present invention.

Referring to FIG. 1 of the drawings, the reference numeral 10 generally designates a flow chart of a method for determining, in accordance with the present invention, the resistivity flow profile of a formation penetrated by either a vertical, slanted, or horizontal wellbore. In step 12 of the flow chart, while the wellbore is being drilled, a conventional resistivity tool, such as is available from Sperry-Sun Drilling Services in Houston, Tex., is run through the wellbore to sequentially measure record, at each point of a sequence of selected points along the wellbore, a sequential series of measured while drilling (MWD) resistivity measurements, indicative of the formation resistivity while drilling at the respective points. The selected points at which the resistivity is measured are spaced at intervals of from about 1 inch to about 36 inches, and typically from about 3 inches to about 12 inches, and preferably about 6 inches. The depth away from the wellbore into the formation at which the resistivity measurements are measured range from about 8 inches to about 150 inches, and typically from about 10 to about 50 inches, and preferably about 12–18 inches.

The foregoing resistivity measurements may be made by transmitting an electromagnetic wave into the formation, receiving the electromagnetic wave as it is reflected back from the formation, measuring the amplitude attenuation and/or the phase shift between the transmitted and the received waves, and correlating the resistivity of the formation with the amplitude attenuation, the phase shift, and/or a mathematical combination of the amplitude attenuation and phase shift. Because the method of measuring formation resistivity is well known in the art, it will not be described in further detail herein.

Upon completion of drilling and measuring in step 12, in step 14, a period of time is allowed to elapse for drilling mud in the wellbore to permeate into the formation. The period of time may range from about 1 to about 200 hours, and typically from about 2 to about 100 hours, and preferably about 12 to 48 hours.

In step 16, the resistivity tool used in step 12 is run through the wellbore to sequentially measure and record, at approximately the same depth measured and recorded in step 12, and at approximately the same points selectively measured and recorded along the wellbore in step 12, a sequential series of measured after drilling (MAD) resistivity measurements, indicative of the formation resistivity after drilling at the respective points and allowing drilling mud to permeate into the formation.

Figure 2:
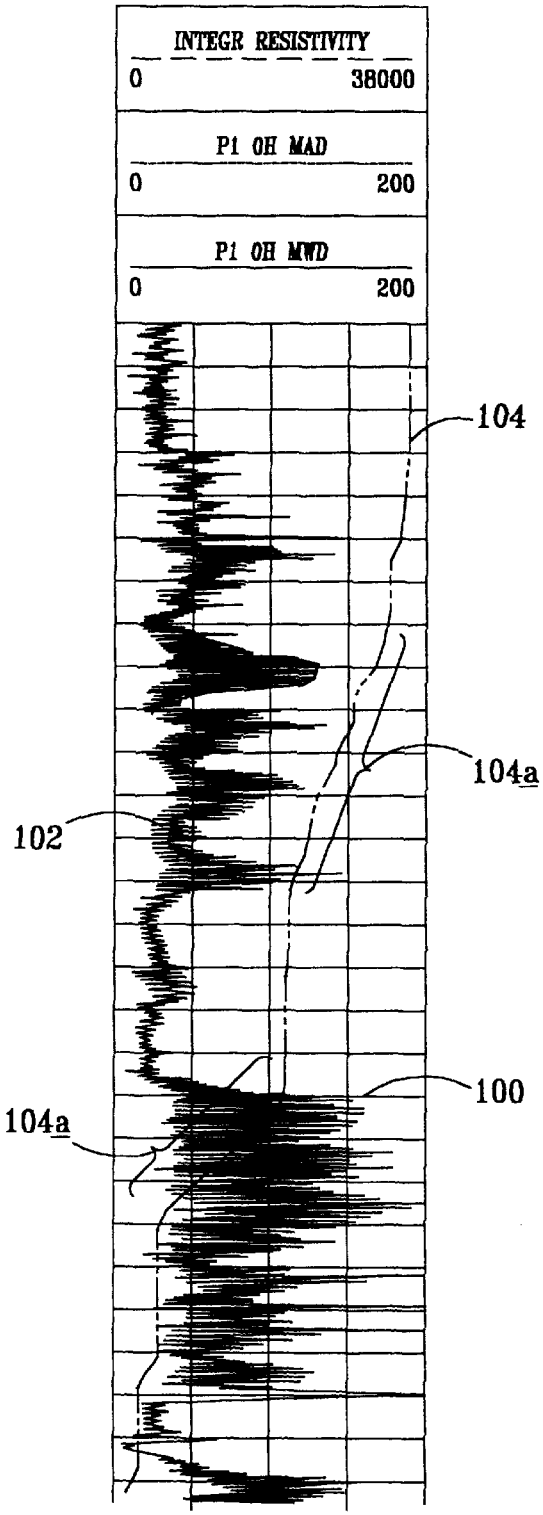
FIG. 2 is a plot of data derived using the method of FIG. 1.

In step 18, a first curve 100 and a second curve 102, shown in FIG. 2, are generated, in a manner well known in the art, from the respective MWD and MAD resistivity measurements recorded for each point to generate respective MWD and MAD curves. In step 20, the first and second curves 100 and 102, respectively, are optionally overlaid, as exemplified in FIG. 2. In step 22, the arithmetic difference between the MWD and the MAD curves is calculated and recorded for each point. In step 24, a value is recorded for each respective point in the sequence of points, each of which values represents the integration of the separation between the MWD and the MAD curves from the last point to the respective point, which integration is calculated as the sum of the differences calculated in step 22 for the respective point and each point which follows the respective point in the sequence of points. In step 26, a third curve 104 is generated of the sequence of the values calculated for each point in step 24, which third curve may optionally be overlaid with the first and second curves 100 and 102 and/or scaled or normalized as desired in a manner well known in the art. The third curve 104 represents the resistivity flow profile of the wellbore based on the integration of the differences between the MWD and the MAD resistivity measurements, wherein the magnitude of the permeability of a zone in the formation and, hence, of the potential productive flow from that point in the wellbore, is substantially proportional to the magnitude of the slope of the profile corresponding to that point in the third curve. For example, the portions 104*a* of the first profile depicted in FIG. 2 indicate that zones of the formation corresponding to those portions are permeable and have a high probability of being productive.

In step 30, the wellbore is completed as an open hole, a cemented casing, or a slotted liner and brought on production in a conventional manner. In step 32, a conventional production logging string is run through the wellbore while the wellbore is flowing to measure at least one of the temperature, pressure, fluid density, capacitance of the formation, and flow rate of fluid in the wellbore, and to generate profiles thereof, including a flow rate profile. Because the method of generating such conventional production logs and profiles is well know, it will not be described in further detail herein.

Figure 3:
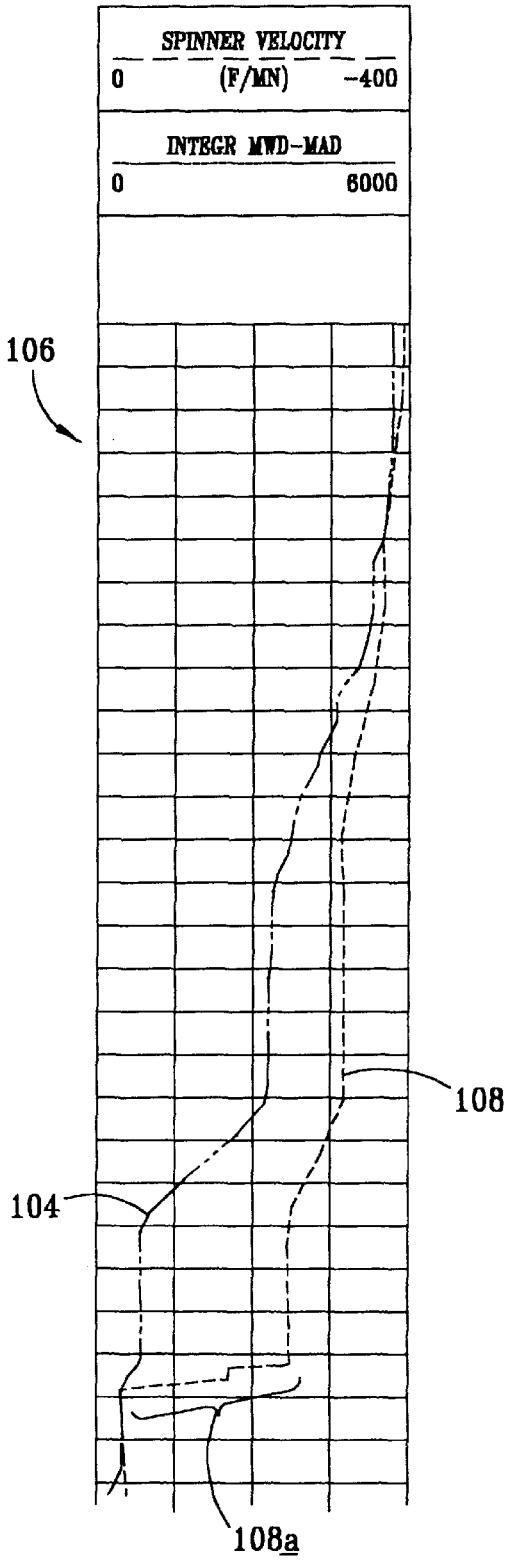
FIG. 3 is a plot of data derived using the method of FIG. 1.

As exemplified in FIG. 3, in step 40, a plot 106 is optionally generated by overlaying the flow rate profile, designated by the reference numeral 108, with the resistivity flow profile derived from the third curve 104. It can be appreciated that, because the resistivity flow profile is derived from resistivity measurements made after having allowed drilling mud to permeate into the formation, the resulting resistivity flow profile correlates primarily with the liquid, rather than the gas, permeability of the formation. In contrast, the flow rate profile developed during the conventional production logging of the wellbore in the foregoing step 32 is responsive to the flow of both liquid and gas in the wellbore. Thus, in step 42, the resistivity flow profile with the flow rate profile are compared and points in the wellbore, such as point 108*a*, are identified where there is a change in the separation between the profiles as indicative of locations where there may be a zones of gas entry. The resistivity flow profile may thus be used in the practice of the method of the present invention to more reliably interpret the conventional production logs generated for the wellbore in the foregoing step 32.

In the further practice of the present invention, strong cooling recorded by the temperature log generated in step 32 may be used to confirm that separation between the profiles is the result of a gas entry zone. Additionally, the relative ratio of the gas-to-liquid in the wellbore may be approximated quantitatively as the ratio of the spinner profile with the resistivity flow profile. Perforations in cemented casing may be more judiciously made for producing oil by perforating the cemented casing in zones where the resistivity flow profile is high.

An injection profile may be generated in a conventional manner when pumping a fluid, such as crude oil or sea water, into the wellbore. In a comparison of the injection profile with the resistivity flow profile, a sudden increase in an injection profile over the resistivity flow profile suggests that gas entry is the result of gas channeling through a fault or a fractured zone, rather than high permeability of the formation.

The practice of the present invention thus provides a profile which may be readily and reliably interpreted from a visual observation and whose analysis may be combined with conventional production logs to provide additional and more reliable information about a wellbore than may be acquired from a conventional production log alone.

It is understood that several variations may be made in the foregoing without departing from the spirit or the scope of the invention. For example, the resistivity flow profile curve of the third curve 104 may be differentiated to provide a profile in which separation is depicted with reference to Cartesian coordinates rather than the slope of the curve. The resistivity flow profile of the curve 104 as well as the differentiated flow profile may also be smoothed over in a manner well known in the art so that they may be more readily interpreted. The third curve 104 may also be generated without overlaying the first and second curves 100 and 102. The drilling mud used in step 14 may be replaced with any suitable fluid such as, for example, fresh water, filtered seawater, or other various drilling fluids. In step 24, a value may be recorded for each respective point in the sequence of points, each of which values represents the integration of the separation between the MWD and the MAD curves from the first point to the respective point, which integration is calculated as the sum of the differences calculated in step 22 for the respective point and each point which precedes the respective point in the sequence of points.

Having thus described the present invention by reference to certain of its preferred embodiments, it is noted that the embodiments disclosed are illustrative rather than limiting and that many variations and modifications are possible within the scope of the present invention. Many such variations and modifications may be considered obvious and desirable by those skilled in the art based upon a review of the foregoing description of preferred embodiments.

What is claimed is:

1. A method for generating a flow profile of a wellbore, comprising the following steps:

(a) running a resistivity tool through the wellbore, while the wellbore is being drilled, and sequentially measuring and recording, at each of a sequence of selected points along the wellbore, a sequential series of resistivities measured while drilling (MWD);

(b) allowing fluid from the wellbore to permeate into the formation;

(c) re-running the resistivity tool through the wellbore, after the fluid has permeated into the formation, and sequentially measuring and recording, at substantially the same points at which the MWD resistivities were made, a sequential series of resistivities measured after drilling (MAD);

(d) calculating for each point the arithmetic difference between the MWD resistivity and the corresponding MAD resistivity recorded for the respective point;

(e) recording, for each respective point in the sequence of points, the sum of the arithmetic differences for the respective point and each point which follows the respective point in the sequence of points; and (f) generating a resistivity flow profile of the wellbore by plotting the value of the sums calculated for each point of the sequence of points, wherein the magnitude of the permeability of a zone in the formation and, hence, of the potential productive flow from that point in the wellbore, is substantially proportional to the magnitude of the slope of the profile corresponding to that point.

2. The method of claim 1 wherein the fluid is selected from the group consisting of drilling mud, fresh water, and seawater.

3. The method of claim 1 wherein at least a portion of each of the steps (a) and (b) are performed concurrently.

4. The method of claim 1 wherein at least a portion of each of the steps (b) and (c) are performed concurrently.

5. The method of claim 1 wherein the wellbore is a horizontal wellbore.

6. The method of claim 1 wherein the steps (a) and (c) of running and re-running the resistivity tool through the wellbore further comprise the steps of transmitting an electromagnetic wave into the formation, receiving the electromagnetic wave as it is reflected back from the formation, measuring the phase shift between the transmitted and the received waves, and correlating the resistivity of the formation with the phase shift.

7. The method of claim 1 wherein the steps (a) and (c) of running and re-running the resistivity tool through the wellbore further comprise the steps of transmitting an electromagnetic wave into the formation, receiving the electromagnetic wave as it is reflected back from the formation, measuring the amplitude attenuation between the transmitted and the received waves, and correlating the resistivity of the formation with the amplitude attenuation.

8. The method of claim 1 wherein the steps (a) and (c) of running and re-running the resistivity tool through the wellbore further comprise the steps of transmitting an electromagnetic wave into the formation, receiving the electromagnetic wave as it is reflected back from the formation, measuring the amplitude attenuation and phase shift between the transmitted and the received waves, mathematically combining the amplitude attenuation and phase shift, and correlating the resistivity of the formation with the mathematically combined amplitude attenuation and phase shift.

9. The method of claim 1 wherein the step of allowing comprises allowing a period of time to elapse, the period of time being from about 1 hour to about 200 hours.

10. The method of claim 1 wherein the step of allowing comprises allowing a period of time to elapse, the period of time being from about 2 hours to about 100 hours.

11. The method of claim 1 wherein the step of allowing comprises allowing a period of time to elapse, the period of time being from about 10 hours to about 50 hours.

12. The method of claim 1 wherein the steps of measuring MWD and MAD resistivities comprise measuring MWD and MAD resistivities at a depth away from the wellbore and into the formation of from about 8 inches to about 150 inches.

13. The method of claim 1 wherein the steps of measuring MWD and MAD resistivities comprise measuring MWD and MAD resistivities at a depth away from the wellbore and into the formation of from about 10 inches to about 50 inches.

14. The method of claim 1 wherein the selected points along the wellbore are spaced at intervals of from about one inch to about three feet.

15. The method of claim 1 further comprising the steps of generating a production log including a flow rate profile through the wellbore, comparing the flow rate profile with the resistivity flow profile, and identifying points where there are substantial changes in the separation between the flow rate profile with the resistivity flow profile as indicative of gas entry points.

16. The method of claim 15 wherein the production log includes a temperature profile and the method further comprises the step of identifying points of strong cooling recorded by the temperature log to confirm that separation between the profiles is the result of a gas entry zone.

17. The method of claim 15 wherein the production log includes an injection profile and the method further comprises identifying a sudden increase in the injection profile over the resistivity flow profile as indicating that gas entry is the result of gas channeling through a fault or a fractured zone, rather than high permeability of the formation.

18. The method of claim 1 further comprising the step of determining the ratio of the flow rate profile with the resistivity flow profile to approximate the relative ratio of the gas-to-liquid in the wellbore quantitatively.

19. The method of claim 1 further comprising the step of perforating casing in the wellbore at zones where the magnitude of the permeability is substantially high.

20. A method for generating a flow profile of a wellbore, comprising the following steps:

(a) running a resistivity tool through the wellbore, while the wellbore is being drilled, and sequentially measuring and recording, at each of a sequence of selected points along the wellbore, a sequential series of resistivities measured while drilling (MWD);

(b) allowing fluid from the wellbore to permeate into the formation;

(c) re-running the resistivity tool through the wellbore, after the fluid has permeated into the formation, and sequentially measuring and recording, at substantially the same points at which the MWD resistivities were made, a sequential series of resistivities measured after drilling (MAD);

(d) calculating for each point the arithmetic difference between the MWD resistivity and the corresponding MAD resistivity recorded for the respective point;

(e) recording, for each respective point in the sequence of points, the sum of the arithmetic differences for the respective point and each point which precedes the respective point in the sequence of points; and (f) generating a resistivity flow profile of the wellbore by plotting the value of the sums calculated for each point of the sequence of points, wherein the magnitude of the permeability of a zone in the formation and, hence, of the potential productive flow from that point in the wellbore, is substantially proportional to the magnitude of the slope of the profile corresponding to that point.

* * * * *